US005524411A

United States Patent [19]

Crossman

[11] Patent Number: 5,524,411

[45] Date of Patent: Jun. 11, 1996

[54] HANDHOLE COVER

[76] Inventor: Robert G. Crossman, 2901 Shady Park Ct., Modesto, Calif. 95355

[21] Appl. No.: 157,812

[22] Filed: Nov. 24, 1993

[51] Int. Cl.[6] ..... E04C 3/30

[52] U.S. Cl. ..... 52/736.1; 52/220.1; 138/92; 174/45 R; 405/232

[58] Field of Search ..... 405/52, 303, 232; 138/92, 94, 89; 220/243, 251; 52/220.1, 221, 98, 736.1; 174/45 R, 38

[56] References Cited

U.S. PATENT DOCUMENTS

| | | | |
|---|---|---|---|
| 943,338 | 12/1909 | Carter et al. | 138/92 X |
| 1,060,693 | 5/1913 | Mueller | 220/251 |
| 1,517,677 | 12/1924 | Heinkel | 220/243 |
| 2,448,838 | 9/1948 | Sohnlein | 220/251 |
| 3,084,827 | 4/1963 | Dyer | 220/251 |
| 3,724,505 | 4/1973 | Jahn | 138/92 |
| 3,755,977 | 9/1973 | Lewis | 138/92 X |
| 4,132,327 | 1/1979 | Van Dyke et al. | 220/251 X |
| 4,339,054 | 7/1982 | Kellogg | 138/92 X |

FOREIGN PATENT DOCUMENTS

| | | | |
|---|---|---|---|
| 909785 | 4/1954 | Germany | 138/92 |

*Primary Examiner*—Dennis L. Taylor
*Attorney, Agent, or Firm*—Bernhard Kreten

[57] ABSTRACT

A cover for a handhole of a utility pole is provided. The cover includes a plate with a bolt passing therethrough and a back bracket threaded to the bolt. The back bracket is configured to engage an inwardly extending lip formed on a periphery of the handhole opening. A plate includes a recess which is directed inward towards the back bracket. The bolt passes through a hole in a floor of the recess. The recess inhibits unauthorized access to a head of the bolt. A spring is interposed between a head of the bolt and the floor which biases the back bracket toward the cover. The back bracket remains in contact with the inwardly extending lip of the handhole opening unless the head of the bolt is depressed, compressing the spring to allow the back bracket to be rotated.

19 Claims, 5 Drawing Sheets

HANDHOLE COVER

FIELD OF THE INVENTION

This invention relates specifically to an alternative cover for the openings found at the base of highway, signal, parking lot and street lighting poles. This invention is designed to cover specific size and shape openings on a variety of lighting poles. More specifically, this invention relates to utility pole handhole covers which are tamper resistant and are easily secured to and removed from the utility pole.

BACKGROUND OF THE INVENTION

Highway, signal, parking lot and street lighting poles all possess similar features. These cylindrical shaped poles are typically made of galvanized steel, and can occasionally be made of aluminum. The poles are secured onto a concrete foundation, which has a conduit containing wires running through it. These wires continue to the top of the pole where the lighting fixture is located.

Approximately one foot up from the base of the pole, there is a small opening just large enough for a hand to fit in. Through this hole, wires are exposed so that electrical work can be accomplished. The dimensions of the most common holes are 6.5 by 4 inches and 5 by 3 inches, and the shape of the hole is either square or oblong. The holes are also raised away from the surface of the pole so a flat plate can be used as a cover.

There are several plates presently being used to cover the holes, and there is even a universal cover (also known as a shell) which wraps around the face of the pole. All of these replacement covers have a screw or bolt through the plate which tightens to a bracket, and after minutes of tightening the screw, the cover can finally be secured to the pole.

The handhole covers that are presently on the poles create many problems for the companies that use them. Most of the covers have a screw head that protrudes from the face of the cover, which makes it visible and tempting to the general public. Because of this, many covers are tampered with and eventually lost or stolen.

However, the companies that use these covers tried to accommodate for this imperfection, which leads to exposed wires, by tightening down the screws even more. This temporary solution only magnified another problem, which was crushing the wires that get caught between the back bracket of the cover structure and the pole.

Still another problem is that the screw or bolt can freeze to the back bracket from rust, which is caused from small amounts of moisture.

The problem with typical covers is that they present hazards for the general public. Exposed wires in poles are attractive to young children who don't understand the dangers of electricity. Also, crushed wires within poles can cause dangerous conditions at night if appropriate lighting is not provided. For example, many accidents are caused when signal lighting shuts off, because the public doesn't understand laws that apply in such circumstances. Crushed internal wires can also allow electricity to flow through the pole itself, if the pole is not grounded correctly.

Accordingly, a need exists for a handhole cover which is easily used by utility personnel but discourages tapering while also not damaging wires in an interior of the pole.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| PATENT NO. | ISSUE DATE | INVENTOR |
|---|---|---|
| 4,914,258 | April 3, 1990 | Jackson |

SUMMARY OF THE INVENTION

This invention provides a cover for the openings on highway, signal, parking lot, and street lighting poles, and is developed to cover specific size holes. A spring loaded cover is provided that has a plate with shoulders which form webbing on an inside surface thereof. The cover occludes the opening. The shoulders of the cover are sized to fit inside the hole and prevent the cover from being turned. Thus the cover does not only overlie the opening, but also fits within the opening.

The cover is attached to the pole by using a screwdriver to push in on a bolt configured to contract a spring. With the bolt pushed in and turned to the right approximately 90 degrees a back bracket will lock the cover in place. The back bracket has notches, so that when the bolt is turned to the right the back bracket cannot be turned beyond a wall of the opening, but rather is locked in place. To remove the cover using a screwdriver, the bolt is pushed in and turned to the left approximately 90 degrees. This causes the spring to be compressed and the back bracket's shoulder to release the wall of the opening. The bolt going through the plate, spring, and back bracket is secured in place by using a lock nut, which allows for easy installation. The combination of a spring and lock nut keeps all of the components of the spring-loaded cover tightly attached. This prevents loss of parts of the cover within the pole handhole opening.

OBJECTS OF THE INVENTION

A primary objective of this invention is to provide a cover having the capabilities of covering the most common size pole handholes quickly, inexpensively, and effectively.

Another object of this invention is to prevent theft, vandalism, and to protect all internal wiring from tampering by children and/or vandals.

Another further object of the present invention is to provide a handhole cover that requires no assembling by the purchaser.

Another further object of this invention is to prevent crushed wires and to eliminate the possibilities of a screw or bolt of the cover from rusting together with the back bracket.

Another further object of this invention is to provide a cover which is easily manufactured from commonly available materials.

Viewed from a first vantage point, it is an object of the present invention to provide a cover for an access opening on a utility pole in which the access opening includes a peripheral edge with a lip extending outwardly away from the pole and a lip extending inwardly toward an interior of the pole, the cover comprised of a means to cover the opening including means for nesting within the outwardly extending lip and, a latch for holding said covering means over the opening, said latch including means to coact with the inwardly extending lip.

Viewed from a second vantage point, it is an object of the present invention to provide a device for covering a handhole of a utility pole, the device comprised of an outer cover sized to overlie an exterior of the handhole, a latch adapted to engage a structure within a hollow interior of the utility pole, and a resilient connection between said latch and said cover.

Viewed from a third vantage point, it is an object of the present invention to provide a method for precluding access to a handhole opening in a utility pole, the opening having a periphery with an inwardly extending lip and an outwardly extending lip, including the steps of providing a cover dimensioned to overlie the opening, the cover including a bolt passing therethrough and threaded to a back bracket, orienting the cover to overlie the opening and adjacent the outwardly extending lip with the back bracket within an interior of the pole, biasing the back bracket to be attracted toward the cover, applying a force upon the back bracket, extending the back bracket beyond the inwardly extending lip, rotating the back bracket to align a portion of the back bracket over the inwardly extending lip, and releasing the force applied in said applying step.

These and other objects will be made manifest when considering the following detailed specification when taken in conjunction with the appended drawing figures.

DESCRIPTION OF PREFERRED EMBODIMENTS

Figure 1:
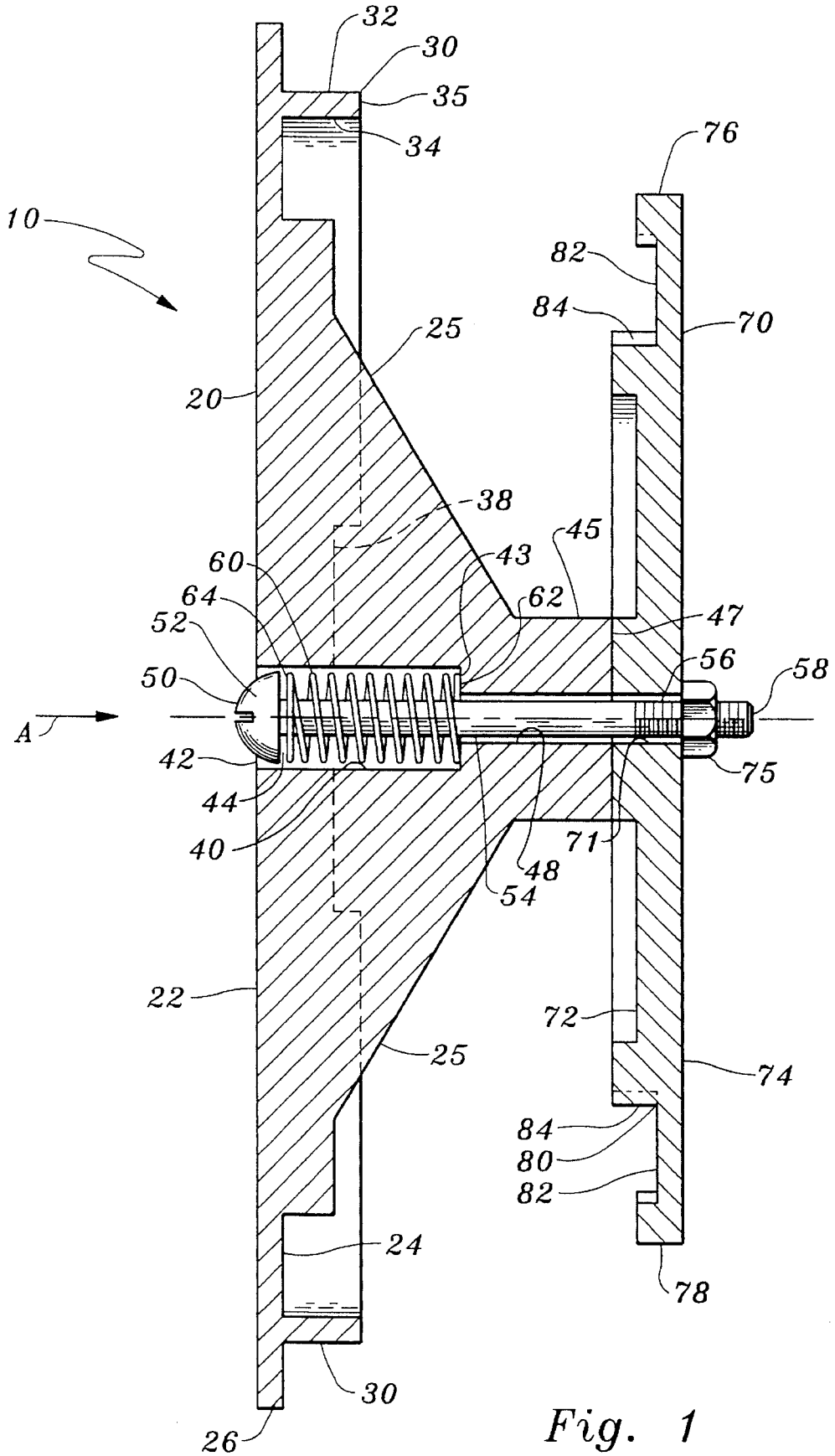
FIG. 1 is a side view in section of the cover of this invention showing the spring-loaded cylinder.
Figure 5:
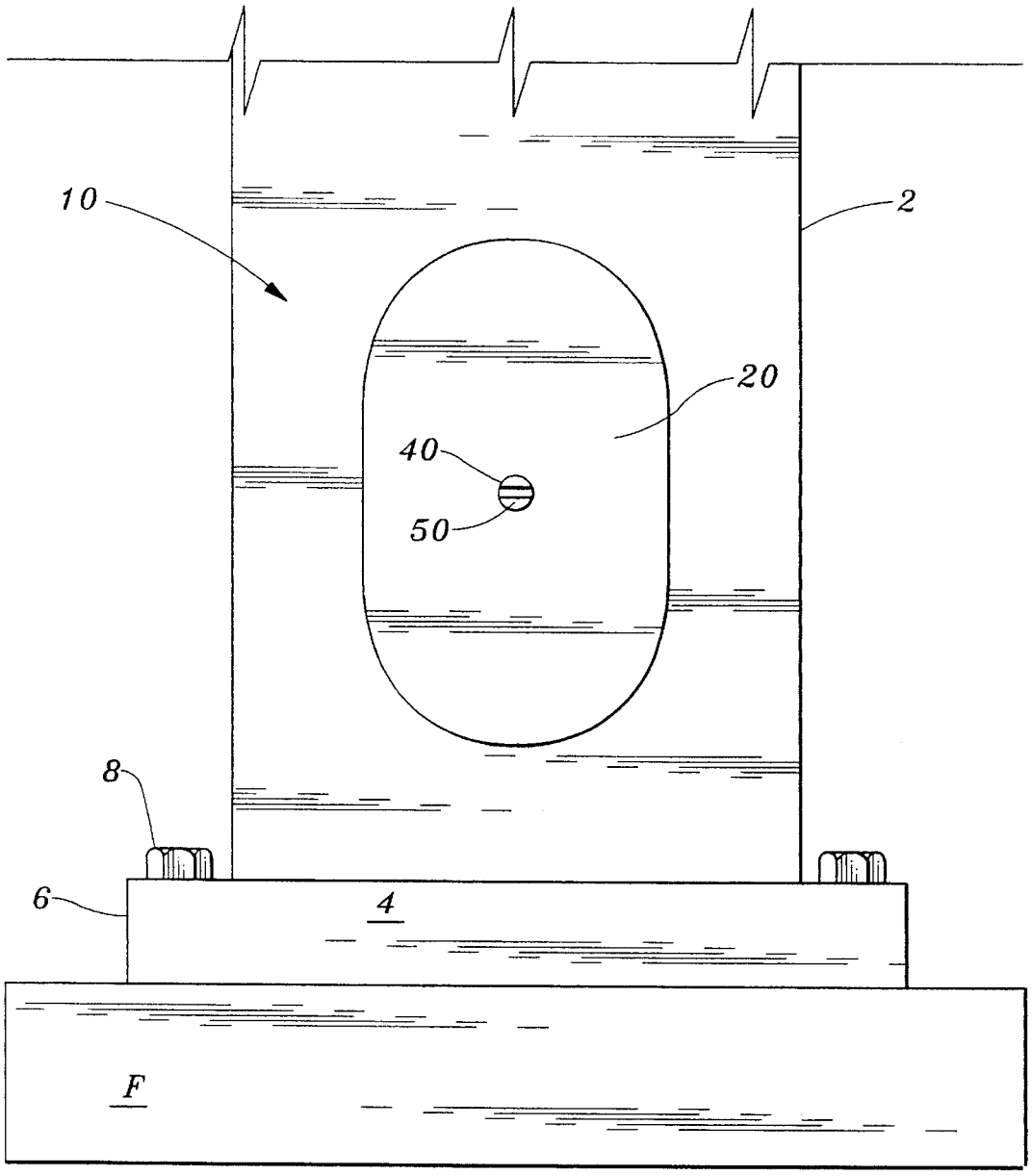
FIG. 5 is a front view of the cover installed upon a pole handhole.

Referring now to the drawings, wherein like reference numerals represent like parts throughout the drawings, reference numeral 10 is directed to a handhole cover for a handhole 12 of a utility pole 2 (FIGS. 1 and 5). The handhole 12 is located near a base 4 of the pole 2 which includes a flange 6 connected through basebolts 8 to a foundation F. The handhole cover 10 is configured to cover a handhole opening 12 to preclude access to an interior I of the pole 2.

In essence, and with reference to FIG. 1, the handhole cover 10 includes a plate 20 adapted to reside over a handhole 12 (FIG. 2) and a back bracket 70 which connects to the pole 2 within the interior I. The plate 20 includes webbing 30 on an inner surface 24 thereof which is strategically located to securely nest within external lips 16 of a periphery 14 of the handhole opening 12. The plate 20 includes a recess 40 on an outer surface 22 thereof which extends toward the back bracket 70. A bolt 50 passes through a bolt hole 48 in a floor 43 of the recess 40 and extends through to a nut 75 located adjacent a back wall 74 of the back bracket 70. A spring 60 is interposed between a head 52 of the bolt 50 and the floor 43 of the recess 40. The spring 60 biases the back plate 70 toward the plate 20. The back bracket 70 includes notches 80 on a front wall 72 of the back bracket 70. The notches 80 are located in positions which correlate with positions of an internal lip 18 of the periphery 14 of the handhole 12. The notches 80 provide a secure connection of the back bracket 70 to the internal lip 18 of the handhole 12.

Figure 2:
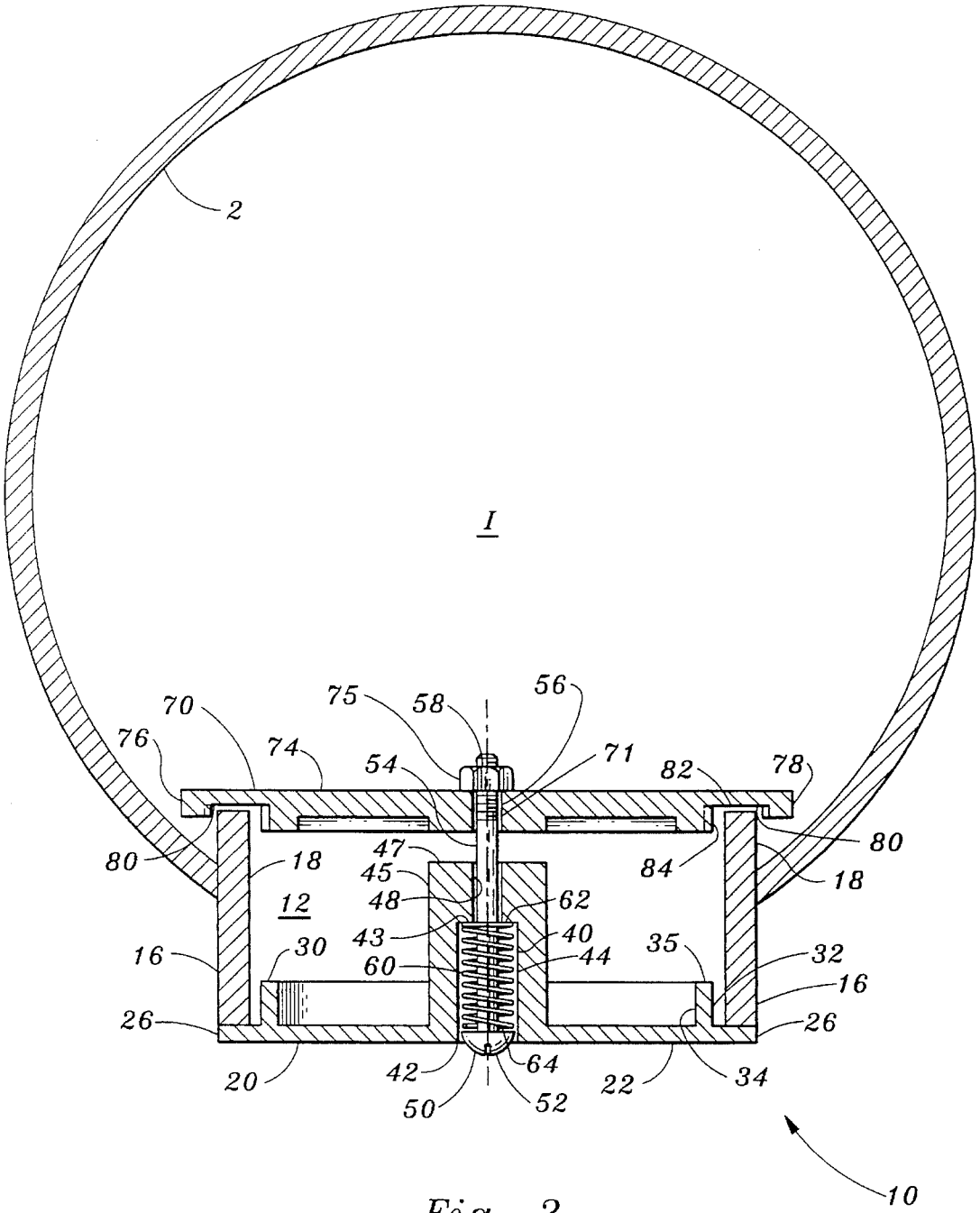
FIG. 2 is a top view in section of the cover of this invention.
Figure 3:
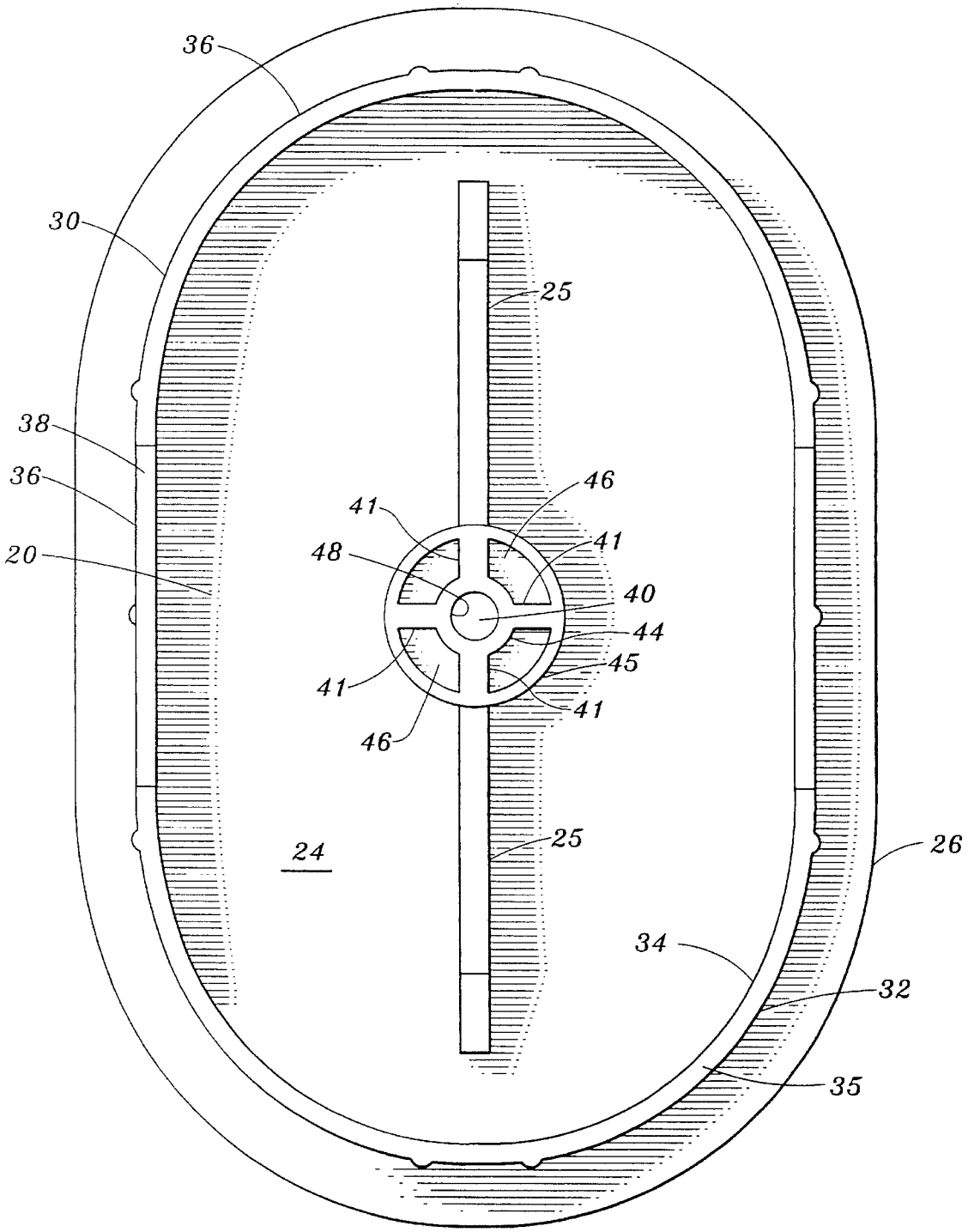
FIG. 3 is a rear view of the cover of this invention showing the webbing along the inside of the face plate.

More specifically, and referring in detail to FIGS. 1 through 3, details of the plate 20 are shown. The plate 20 is preferably of a thin rigid substantially oval construction. Some handholes 12 are oval and other handholes 12 are more rectangular in appearance. If the cover 10 is to be used on a rectangularly shaped handhole, the plate 20 would preferably exhibit a complemental rectangular appearance. The plate 20 includes an outer surface 22 parallel to and spaced from an inner surface 24. Edges 26 define a periphery of the plate 20.

Webbing 30 preferably extends perpendicularly away form the inner surface near the edges 26 of the plate 20. As shown in FIG. 3, the webbing 30 preferably is continuous and includes two curves 36 and two straight portions 37. However, a step 38 reduces the webbing 30 to a slightly lesser height adjacent straight portions of the edges 26 of the plate 20. The webbing 30 includes an outside surface 32 parallel to and spaced from an inside surface 34. The inside surface 34 and outside surface 32 extend to a tip 35 of the webbing 30 (FIG. 1). The webbing 30 is configured such that the outside surface 32 can maintain contact with the external lip 16 of the periphery 14 of the handhole 12. Thus, when the plate 20 is oriented adjacent the periphery 14 of the handhole 12, the webbing 30 acts to center and nest the plate 20 within the periphery 14 of the handhole opening 12.

The outer surface 22 of the plate 20 preferably includes a recess 40 near a central location thereof. The recess 40 is cylindrical in form with an inside cylindrical wall 44 extending from an outer opening 42 of the recess 40 adjacent the outer surface 22 of the plate 20 to a floor 43 of the recess 40 parallel to the outer surface 22. An outside cylindrical wall 45 is concentric with the inside cylindrical wall 44 and spaced therefrom. Vanes 41 extend between the two walls 44, 45. Voids 46 are formed between the vanes 41. The outside cylindrical wall 45 and vanes 41 provide structural support to the recess 40 while the voids 46 reduce an amount of material needed to make the cover 10. In addition, gussets 25 extend between the outside cylindrical wall 45 and the inside surface 34 on an upper and lower side of the recess 40. The gussets further strengthen the recess 40. The outside cylindrical wall 45 terminates at an abutment 47 which is parallel to the inner surface 24 of the plate 20. A bolt hole 48 passes from the floor 43 through to the abutment 47. The recess 40 acts to shield a bolt 50 passing through the bolt hole 48 from the view of potential vandals. In addition, the inside cylindrical wall 44 is configured to have a minimum necessary diameter, thereby preventing activation of the bolt 50 without a properly designed elongate rotational tool such as a screwdriver.

A bolt 50 is oriented through the bolt hole 48 and passing through the back bracket 70. The bolt 50 includes a head 52 oriented at an end of the bolt hole 48 nearest to the plate 20. The head 52 is supported upon a shaft 54 which extends through the bolt hole 48. Threads 56 are located upon the shaft 54 at a tip 58 of the shaft 54 distant from the head 52 of the bolt 50. The back bracket 70 has a hole 71 passing therethrough sized to allow the shaft 54 of the bolt 50 to threadably pass therethrough.

A nut 75 having threads complemental to the threads 56 of the bolt 50 are located against a back wall 74 of the back bracket 70. Preferably, the hole 71 of the back bracket 70 is threaded and the nut 75 is of a "lock nut" variety. However, the hole 71 could also be unthreaded and the nut 75 can be fixedly attached to the back wall 74 of the back bracket 70. By allowing the bolt 50 to thread into the back bracket 70, through the nut 75, a tightness of the back bracket 70 with relationship to the plate 20 can be adjusted. If such adjustment is not necessary, the bolt 50 can be rigidly connected to the back bracket 70 adjacent the tip 58 of the bolt 50.

A spring 60 is interposed between the head 52 of the bolt 50 and the floor 43 of the recess 40. The spring 60 is preferably of the helical compression spring variety and is oriented surrounding the shaft 54 of the bolt 50 and coaxial with the shaft 54 of the bolt 50. The spring 60 includes a first end 62 adjacent the floor 43 and a second end 54 adjacent the head 52 of the bolt 50. The spring 60 causes the bolt 50 to be moved toward the plate 20 until the back bracket 70 abuts against the internal lip 18 of the periphery 14 of the handhole 12. The spring 60 thus biases the back bracket 70 toward the plate 20. The spring 60 is preferably provided with a spring constant which allows a user to easily compress the spring 60, causing the second end 64 to move toward the first end 62 and causing the back bracket 70 to engage and disengage form the internal lip 18.

Figure 4A:
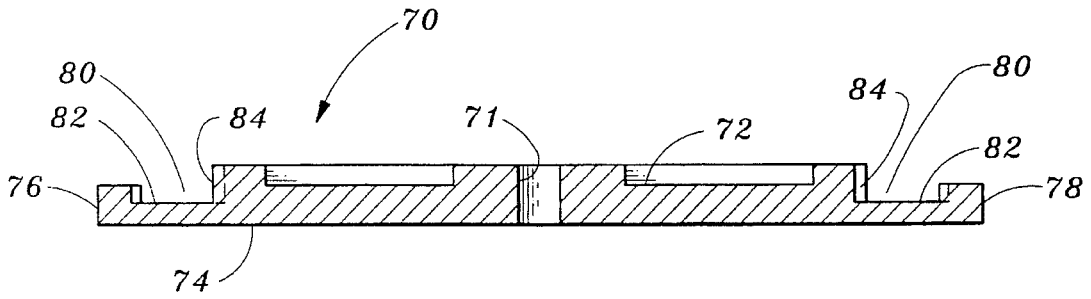
FIG. 4A is a front view of the back bracket of this invention which locks the cover in place.
Figure 4B:
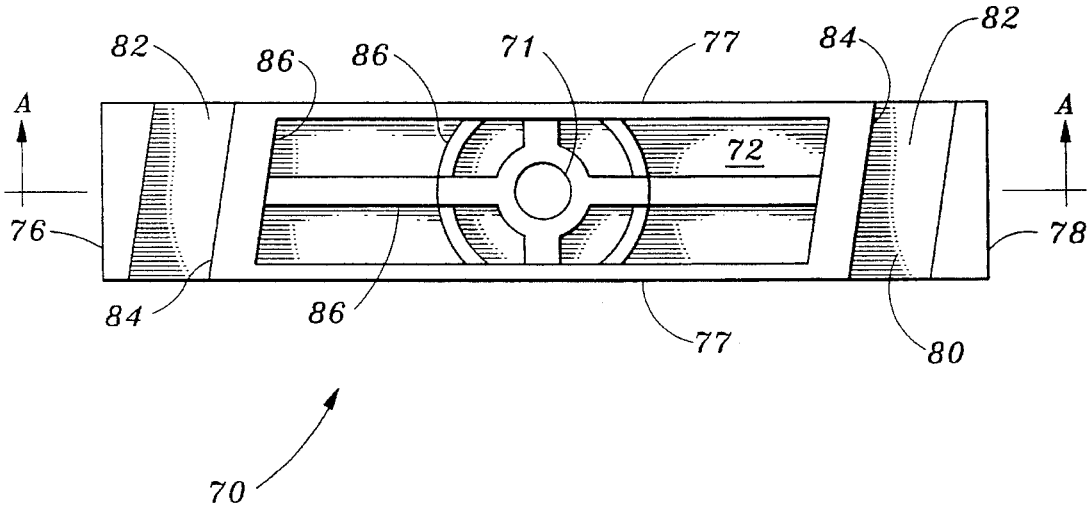
FIG. 4B is a top view of the back bracket of this invention.

Referring now to FIGS. 4A and 4B, the back bracket 70 is a thin rigid rectangular construct including a planar front wall 72 spaced from a planar back wall 74. The hole 71 passes perpendicular through a geometric center of the back bracket 70. The back bracket 70 is dimensioned such that a longest dimension measured between a first end 76 and second end 78 is greater than a least width of the periphery 14 of the handhole opening 12. Thus, when the back bracket 70 is oriented with the first end 76 and second end 78 adjacent portions of the internal lip 18 of the periphery 14 defining a least width of the handhole opening 12, the back bracket 70 can contact both sides of the internal lip 18 simultaneously.

Notches 80 are formed in the front wall 72 of the back bracket 70 adjacent both the first end 76 and the second end 78. Each of the notches 80 includes a floor 82 parallel to the front wall 72 and two side walls 84 perpendicular to the floor 82 and which define sides of the notches 80. These sidewalls are preferably spaced a distance similar to a thickness of the internal lip 18 of the periphery 14. The notches 80 are spaced apart from each other a distance similar to a distance between opposite sides of the internal lip 18. Thus, when the back bracket 70 is appropriately oriented, the notches 80 can overlie and receive the opposite sides of the internal lip 18, preventing further rotation of the back bracket 70 until the back bracket 70 is displaced toward an interior I of the pole 2 away from the internal lip 18 of the periphery 14. The back bracket 70 thus acts as a latch for the cover 10. The notches 80 are preferably oriented to extend at an angle skewed from perpendicular to edges 77 of the back bracket 70.

The front wall 72 of the back bracket 70 also includes a network of ribbing 86. The ribbing 86 provides structural strength to the back bracket 70 where needed and further reduces an amount of material necessary in forming the cover 10. The ribbing 86 is particularly configured to provide support surrounding the threaded hole 71 and adjacent the notches 80.

In use and operation, and with reference to FIGS. 1 and 2, the handhole cover 10 is utilized in the following manner. Initially, the cover 10 is configured as shown in FIG. 1 with the spring 60 causing the back bracket 70 to be adjacent the abutment 47 of the recess 40. The first end 76 and second end 78 of the back bracket 70 are aligned so that the back bracket 70 can easily pass through the handhole opening 12. In most cases, this is a vertical orientation with a longest dimension of the plate 20 also oriented vertically. The plate 20 is then translated horizontally along arrow A, until the inner surface 24 of the plate 20 abuts against the external lip 16 of the periphery 14 of the handhole 12. The webbing 30 nests the plate 20 between the external lip 16 of the periphery 14 and securely holds the plate 20 in a non-rotational manner adjacent the pole 2 (FIG. 5).

To cause the cover 10 to be secured to the handhole opening 12 of the pole 2, a screwdriver or other elongate tool configured to engage a head 52 of the bolt 50 engages the head 52 of the bolt 50 and is translated longitudinally along arrow A. The bolt 50 thus travels horizontally, while the spring 60 is compressed, toward the interior I of the pole 2, causing the second end 64 of the spring 60 to approach the first end 62 of the spring 60, until the back bracket 70 is closer to the interior I than is the internal lip 18 of the periphery 14. The tool is then utilized to rotate the bolt 50 approximately 90° to the right. The tool is then removed from the bolt head 52 and the back bracket 70 is allowed to travel toward the plate 20, under action of the spring 60, until the ends 76, 78 of the back bracket 70 abut against the internal lip 18 of the periphery 14. A user can utilize the tool to rotate the bolt 50 slightly in both directions until adequately assured that the notches 80 have been positioned resting over the internal lip 18 of the periphery 14. Once the cover 10 is secured within the periphery 14 of the handhole opening 12, the cover 10 exhibits an appearance as shown in FIG. 2.

Removal of the cover 10 can be accomplished by reversal of the above steps. Namely, a tool is used to compress the bolt 50 slightly, the bolt 50 is rotated approximately 90°, and the tool is released, allowing the cover 10 to be evacuated from the handhole opening 12.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A flat cover for an access opening on a cylindrical utility pole having substantially constant circular cross-section and in which the access opening of the utility pole includes a peripheral edge with a lip circumscribing the opening and projecting outwardly away from the pole to provide a cover purchase area and a lip circumscribing the opening and projecting inwardly toward an interior of the pole to provide a secure connection with said flat cover, said flat cover comprising in combination:

a means to cover the opening including means for nesting within the outwardly extending lip, said covering means is a plate having an inside surface and an outside surface opposite said inside surface, said plate sized to overlie the outwardly projecting lip of the opening of the pole, and a latch for holding said covering means over the opening, said latch including means to coact with the inwardly extending lip.

2. The device of claim 1 wherein said nesting means is webbing extending from said inside surface of said covering means, said webbing configured to nest within the outwardly extending lip of the opening.

3. The device of claim 2 wherein said coacting means is a back bracket, said back bracket operatively coupled to said latch and said cover in a manner allowing said back bracket to selectively extend in one position over the inwardly extending lip and in another position not over said inwardly extending lip, whereby said bracket allows said latch to hold said covering means over the opening when said back bracket overlies the inwardly extending lip.

4. The device of claim 3 wherein a bolt is provided passing through said plate and coupled with threads to said back bracket, whereby when said bolt is rotated, said bracket is drawn toward said plate.

5. The device of claim 4 further including a means to bias said bracket to be attracted toward said plate.

6. The device of claim 5 wherein said plate includes a recess therein, said recess formed on an outer surface of said plate and extending through said plate toward said back bracket, said recess having a hole in a floor thereof receiving said bolt therethrough.

7. The device of claim 5 wherein said bias means is a spring interposed between a head of said bolt and said floor of said recess, whereby said spring causes said bolt to draw said back bracket toward said plate.

8. The device of claim 7 wherein said bracket includes a plurality of notches thereon, said notches having a width not less than a width of the inwardly extending lip of the opening, whereby when said bracket is located with said notches overlying the inwardly extending lip, said notches engage the inwardly extending lip.

9. The device of claim 8 wherein said webbing includes an outside surface which corresponds to a contour of the outwardly extending lip of the opening.

10. The device of claim 9 wherein said plate is a substantially planar rigid construct having edges which conform to a shape of the opening of the utility pole.

11. A flat device for covering a handhole of a cylindrical utility pole, the device comprising in combination:

an outer cover sized to overlie an exterior of the handhole, a latch adapted to engage a structure within a hollow interior of the utility pole, and a resilient connection between said latch and said cover including means to cause said latch to contract towards said cover to wedge said cover and latch on opposite sides of the handhole.

12. The device of claim 11 wherein said latch includes a rotatable back bracket having a greatest dimension not less than a least width dimension of the handhole.

13. The device of claim 12 wherein said resilient connection includes a bolt with a head on an outer surface of said outer cover and a threaded portion operatively coupled to said back bracket.

14. The device of claim 13 wherein said bolt head is oriented within a recess in said cover, said recess extending away from said outer surface, said recess having an inside wall with a minimal diameter necessary to allow rotation of said bolt, but prohibiting a foreign object from being inserted between said bolt head periphery and said inside wall of said recess, whereby access to said bolt head is inhibited unless an appropriate elongate tool is utilized.

15. The device of claim 14 wherein said resilient connection includes a spring interposed between said bolt head and said cover, said spring oriented to translate said bolt head outward away from said cover, whereby said spring causes said back bracket to be biased toward said cover.

16. A method for precluding access to a handhole opening in a cylindrical utility pole, the opening having a periphery with an inwardly extending lip and an outwardly extending lip, including the steps of:

providing a flat cover dimensioned to overlie the opening, the cover including a bolt passing therethrough and threaded to a back bracket, orienting the cover to overlie the opening and adjacent the outwardly extending lip with the back bracket within an interior of the pole, biasing the back bracket to be attracted toward the cover, applying a force upon the back bracket, extending the back bracket away from and beyond the inwardly extending lip providing clearance with the inwardly extending lip, rotating the back bracket to align a portion of the back bracket over the inwardly extending lip, and releasing the force applied in said applying step;

whereby the biasing of the back bracket causes the back bracket to abut against the inwardly extending lip, holding the cover over the opening.

17. The method of claim 16 including the further step of recessing a head of the bolt away from an exterior of said cover and toward said back bracket.

18. The method of claim 17 wherein said biasing step includes the step of providing a spring between the bolt head and a floor of the recess.

19. The method of claim 18 including the further step of securing the cover within the opening by providing notches on the back bracket, the notches having a width corresponding to a width of the inwardly extending lip of the opening and oriented to engage the inwardly extending lip of the opening during said rotating step.

* * * * *